US005193994A

United States Patent [19]

Schirneker

[11] Patent Number: 5,193,994

[45] Date of Patent: Mar. 16, 1993

[54] CANDLE WITH A FLOATING WICK SUPPORT

[76] Inventor: Hans-Ludwig Schirneker, Engelslit 10, D-4773 Möhnesee-Völlinghausen, Fed. Rep. of Germany

[21] Appl. No.: 650,917

[22] Filed: Feb. 5, 1991

[30] Foreign Application Priority Data

Feb. 5, 1990 [DE] Fed. Rep. of Germany ... 9001271[U]
May 30, 1990 [DE] Fed. Rep. of Germany ..... 4017383

[51] Int. Cl.[5] ..... F23D 3/16

[52] U.S. Cl. ..... 431/293; 431/291; 431/297; 431/289

[58] Field of Search ..... 431/33, 34, 35, 88, 431/144, 288, 289, 291, 292, 293, 297, 315; 362/161, 163, 180, 314, 447; 264/298, 254

[56] References Cited

U.S. PATENT DOCUMENTS

| | | | |
|---|---|---|---|
| 350,710 | 10/1886 | Whyte | 362/447 |
| 1,390,873 | 9/1921 | Boileau | 431/315 |
| 1,577,550 | 3/1926 | Woerner | 431/144 |
| 1,890,378 | 12/1932 | Godoy | 362/161 |
| 2,111,642 | 3/1938 | Saier | 431/297 |
| 2,229,131 | 1/1941 | Root | 431/288 X |
| 2,324,723 | 7/1943 | Powers et al. | 431/293 |
| 3,428,409 | 2/1969 | Summers | 431/289 |
| 3,462,235 | 8/1969 | Summers | 431/293 X |
| 4,013,397 | 3/1977 | Neugart | 431/320 X |
| 4,507,077 | 3/1985 | Sapper | 431/288 |

FOREIGN PATENT DOCUMENTS

| | | | |
|---|---|---|---|
| 273851 | 8/1969 | Austria | 431/293 |
| 747 | 12/1899 | Fed. Rep. of Germany | 431/293 |
| 329715 | 3/1919 | Fed. Rep. of Germany | 431/289 |
| 2909687 | 9/1980 | Fed. Rep. of Germany | 431/288 |
| 205547 | 9/1939 | Switzerland | 431/291 |
| 2396 | of 1884 | United Kingdom | 431/293 |
| 1248 | of 1886 | United Kingdom | 431/288 |

*Primary Examiner*—Carl D. Price
*Attorney, Agent, or Firm*—Pearne, Gordon, McCoy & Granger

[57] ABSTRACT

A candle is disclosed which comprises at least one body, which is composed of a material which is solid at room temperature such as wax or paraffin, and a wick. The body which is composed of a combustible material which is solid at room temperature, has, at least at the bottom end, a part which can be plugged together or connected with a mating part of an identical body. At the top end of the uppermost body, a tubular headpiece which surrounds said body is provided and is guided, at least at its bottom end, and moves downwards with the burning-down candle.

3 Claims, 10 Drawing Sheets

CANDLE WITH A FLOATING WICK SUPPORT

BACKGROUND OF THE INVENTION

The invention relates to a candle or the like comprising a body composed of a material which is solid at room temperature, such as wax or paraffin, and a burning element such as a wick. The invention also relates to a method for the manufacture of such candles.

When the term 'candle' is used herein, this generically includes every lighting member which has a wick for a light-emitting flame, said wick being supplied with a combustible material which is rendered liquid by the supply of heat, but which is solid at room temperature. In this regard, the candle may also form part of a storm lantern or any other illuminating body, the light of which is supplied by an open flame.

In the case of storm lanterns, it is known to arrange a candle on a base and to surround the candle with a protective covering of, for example, glass. The covering protects the flame of the candle against draughts, with the result that the flame burns relatively steadily. An elevated temperature, however, results in the interior of the storm lantern owing to the covering, with the result that the candle shows an increased tendency to melt down and to run out. In addition, it is also not possible to prevent all flickering of the flame, which leads to an increased soot production. Once the candle has burned down, a residue of wax always remains and must be thrown away.

Known candles comprise a body composed of wax or paraffin into which is drawn or inserted a textile wick which passes through said body in a longitudinal direction, and said body has, on its outside, a layer of hard wax for the purpose of preventing a run-out of the wax or paraffin when liquefied by the flame. In the case of extended burning times of the candle, it does, however, frequently occur that the liquefied wax or paraffin drips down and runs out, despite the outer layer of hard wax, thereby staining or damaging the support, such as a table, table cloth, etc. As stated above, such candles also do not burn down completely. Indeed, there is always a non-burned residue of the candle which frequently amounts to at least about 10% of the original candle body and which must be thrown away. In addition, the manufacture of such candles is relatively costly because of the textile wick passing through said candles and because of the coating of hard wax. The known candles also burn irregularly with regard to the height of their flame. An adjustment or changing of the flame height is, practically, not possible.

SUMMARY OF THE INVENTION

Object of the invention is to prevent the above-mentioned disadvantages of known storm lanterns and, in particular, known candles, and to provide a candle in accordance with the definition given at the outset, which can burn down without non-burned residue, uniformly and with a steady flame, not being subjected to any limitations of the burning duration, and an economical manufacture being made possible.

As a result of the invention, a candle is provided which is also utilizable for a storm lantern and the body of which, composed of wax or paraffin, does not, of necessity, require an outer coating of hard wax, and in which the wick does not have to pass completely through said body, although this is not impossible. The essential point is that the body, which is composed of a combustible material which is solid at room temperature, such as wax or paraffin, is designed such that a plugging in or plugging on to other bodies of the same kind is possible, such that a body of the candle or the like, which is composed of combustible material which is solid at room temperature, can burn down completely and an identical body, if placed below it in good time, can, without interruption, supply the liquefied burning agent or combustible material. According to the invention, a uniform burning-down, practically without non-burned residue, is achieved hereby.

The burning element of the candle according to the invention is, preferably, designed as a wick support which is capable of floating, i.e. no textile wick which passes in a longitudinal direction through the entire body composed of wax of paraffin, is provided, and instead, a wick support is provided having a long-duration wick which is placed in position on the upper end of the wax or paraffin body and floats on the liquefied burning agent or combustible material and, in so doing, is continuously supplied with burning agent and sinks down together with the wax or paraffin body which becomes shorter as it burns down.

The wick support may be provided with a short wick, a ball wick, a cone wick, a cylinder wick or a disc wick. The headpiece may be of plastics materials, glass, porcelain, metal, etc. and, preferably, comprises a heat-conducting ring, preferably of metal. Said heat-conducting ring may be designed to be inwardly conical and may, in the upper region, have a diameter which is less than that of the body composed of wax or paraffin, for example an inside diameter which is less by 1 mm. A support means for a long-duration wick of any desired design which is, preferably, of inorganic material may be arranged above said heat-conducting ring. Said wick support can, for example, be supported on an inclined plane of the headpiece such that a vertical adjustment is possible. The inside diameter of the bottom end of the headpiece is adapted, with a certain clearance, to the outside diameter of the candle body composed of wax or paraffin. A protecting means can be mounted on or attached to the headpiece for the purpose of protecting the flame against any possible outside draught.

The pedestal which serves as a support for the candle can be composed of a wide variety of materials and can have various different shapes. At all events, it is advisable that it have an opening or receiving means for the candle body which is composed of wax or paraffin.

When this candle is used, prior to the first-time lighting thereof, a few pieces of wax or a ring of wax may be placed in the vicinity of the wick and the flame immediately starts the melting thereof and they thus, initially, serve as combustible material. Within a short period of time, the entire upper surface of the wax body has melted and the heat-conducting ring becomes hot. As a result, more wax melts in the region of the heat-conducting ring. The wick support and wick and a headpiece which may, optionally, be present and a protecting means can, gradually, move downwards, in keeping with the consumption of wax. The faster this procedure takes place, the shorter the end of the wick projecting out of the liquid wax becomes and, therefore, also the flame. When the type of wax, the diameter of the wick, the vertical arrangement of the wick, and of the heat-conducting ring, etc. are correctly co-ordinated, the height of the flame always remains substantially the same. If, however, a regulating device is provided, it is possible to intervene in the regulating in order to adjust the flame so as to be larger or smaller, as desired.

When the wax body is largely consumed, a further wax body of the same kind can be fitted below the first without it being necessary to extinguish the flame. The plug connection between two wax bodies does not interfere with the perfect burning-down.

The protection means of umbrella-like covering, which serves as protection against wind, should be designed to be lightweight. It may, for example, be of air-permeable glass wool matting and sheet aluminium.

A wick which is suitable for long-duration burning may be composed of glass wool matting having a sheet metal or wire insert. Said insert rapidly conducts heat downwards after lighting-up, such that sufficient wax melts and is drawn in to permit the flame to burn. The insert also provides the wick with greater stability. It is, however, also possible to use ball wicks, cylinder wicks, cone wicks or disc wicks of gypsum, chalk, glass wool, slag wool and the like, i.e. of porous material.

The uppermost or first used wax body can be designed at its upper end such that the wick support, with its wick, is surrounded by wax and that there is, accordingly, at the start, sufficient wax in very close proximity of the wick which is available for the initial melting. In this regard, the wick support may also be recessed or cast into the wax body.

Whereas the wax or paraffin body which is to be burned first must have a part of a plug connection merely at the bottom end, the subsequent bodies of combustible material have a part of a two-part plug connection both at the top and at the bottom end. In this manner, it is possible to form a so-called endlessly burning candle from individual bodies of combustible material.

Although a floating wick support is preferably used in conjunction with wick-less bodies of combustible material, the combustible material bodies may, in each case, also contain a continuous wick of cotton material. The arrangement of the wicks in the bodies of combustible material is then selected such that the flame can pass over, without interchange, from the wick of the one body of combustible material to the wick of the following body of combustible material. This is achieved in that the wick ends of plug-connected bodies of combustible material lie closely next to one another, with the result that, during the transition from one combustible-material body to the following subjacent combustible-material body, the flame is temporarily supplied via two wicks.

The height of the flame can be regulated by means of a headpiece or a tubular socket surrounding the top end of the candle, or by means of an adaptor ring, and, likewise, a run-out or leaking of liquefied combustible material such as wax is prevented, without it being necessary that the combustible-material bodies be provided with a coating of hard wax for this purpose.

Exemplified embodiments of the candle or storm lantern or the like according to the invention are diagrammatically illustrated in the drawing, in which:

DESCRIPTION OF THE PREFERRED EMBODIMENTS

Figure 1:
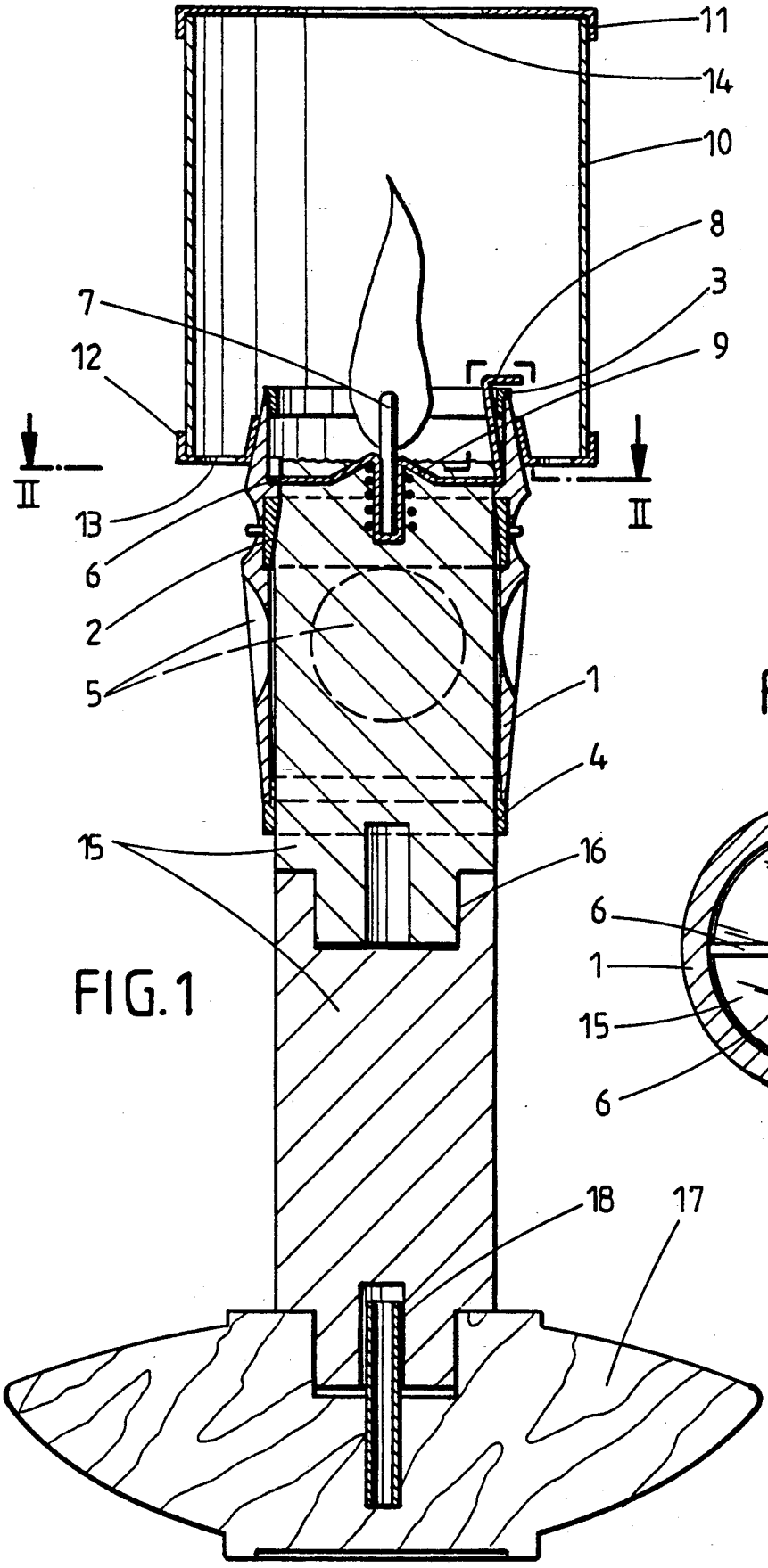
FIG. 1 shows a longitudinal section of a storm lantern having a protecting means and an adjustable wick support.
Figure 2:
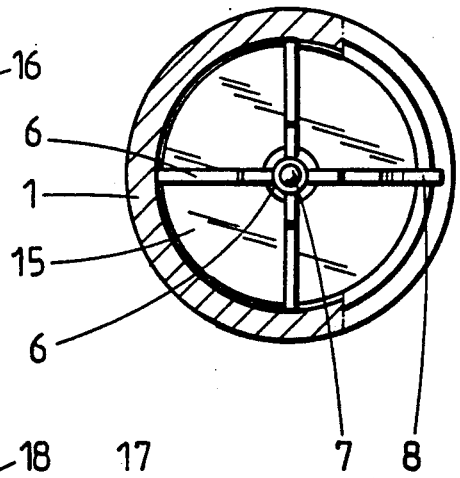
FIG. 2 shows a cross-section of the headpiece of the storm lantern according to FIG. 1.

The storm lantern illustrated in FIGS. 1 and 2 comprises a base pedestal 17, two wax bodies 15, a headpiece 1 and a draught protection means 10.

The headpiece 1 is composed of two parts which are interconnected by a heat-conducting ring 2. A wick support 6 comprising a wick 7 is accommodated in the upper part of the headpiece 1. The wick support 6 is supported on inclined surfaces provided in the headpiece 1 by means of four wire ends. One of the four wire ends of the wick support 6 is bent upwards and serves as adjusting lever 8. The four wires of the wick support 6 are held together in the centre by a coil spring 9 such that paraffin can flow constantly between the individual threads of the spring to the wick 7 which is inserted in the centre.

The headpiece 1 may be composed of not readily flammable plastics material, porcelain, glass, metal or the like, and is covered by an end ring 3, primarily as a flame protection for the headpiece 1. Openings 5 which serve the purpose of cooling and, also, as decoration are provided in the bottom part of the headpiece 1. At the bottom edge of the headpiece 1, an end ring 4 is provided, the inside diameter of which corresponds, with a slight clearance, to the outside diameter of the wax body 15.

The heat-conducting ring 2 is designed to be conical on the inside and is slightly smaller in diameter in the upper part than the wax body 15. The wax bodies 15 have a plug connecting means 16 at their ends and are plugged into one another. The bottom wax body 15 is inserted with a firm fit in the base pedestal 17. A bore is provided in the centre of the base pedestal 17 and of the wax bodies 15, in which bore a wick cleaner 18 is accommodated.

A removable draught protection means 10, which is covered by a cover 11, 12 at the top and at the bottom, is mounted on the headpiece 1. A plurality of air inlet openings 13 are provided in the bottom cover 12, and hot-air exit openings 14 in the top cover 11. The actual protecting means 10 can be manufactured of air-permeable glass wool matting or the like, and the covers 11, 12 of sheet aluminium. It is important that the entire protecting means be designed to be lightweight. The exemplified embodiment of FIG. 3, likewise, comprises a headpiece 19, wax bodies 27 and a base pedestal 29. A heat-conducting ring 20, which is provided with a recess 26, is arranged in the headpiece 19. When burning down, the wax of the top wax body 27 becomes hot at the top end and expands slightly, thereby penetrating into the recess 26. If the storm lantern is now raised at the headpiece 19, the top wax body 27 does not become detached from the headpiece 19, with the result that the liquid wax in the upper part of the headpiece 19 cannot run out.

The wick support is composed of a disc 23 which is provided with holes and on which a pipe socket 24 having a longitudinal slit is arranged. An absorbent material such as glass wool is placed in the pipe socket 24 of the wick support. A ball 25, composed of glass wool, chalk, gypsum or the like, which serves as the wick, is placed on said glass wool. The holes and the slit in the disc 23 and in the pipe socket 24 of the wick support are required for the unobstructed inflow of the liquefied paraffin. If the liquid paraffin does not reach the ball wick 25 placed in position, then the glass wool provides the means that sufficient wax is drawn in and transmitted to the ball wick 25. In the event of an impact upon the storm lantern, the ball 25 immediately falls downward into the liquid wax, with the result that the flame is extinguished.

At the bottom, the headpiece 19 is provided with guiding wires 22 which have the function of maintaining the headpiece in a vertical position when moving downwards, yet they also serve as decoration. The top and bottom wax bodies 27 are interconnected by means of a plug connection 28. A lightly deeper opening for the wax body 27 is provided in the base pedestal 29, such that additional balls 30, serving as wick, can be held in reserve. In this exemplified embodiment, the ball wicks 25 do not require cleaning. If residual matter has accumulated thereon, they are merely replaced by a new ball wick 25.

Figure 4:
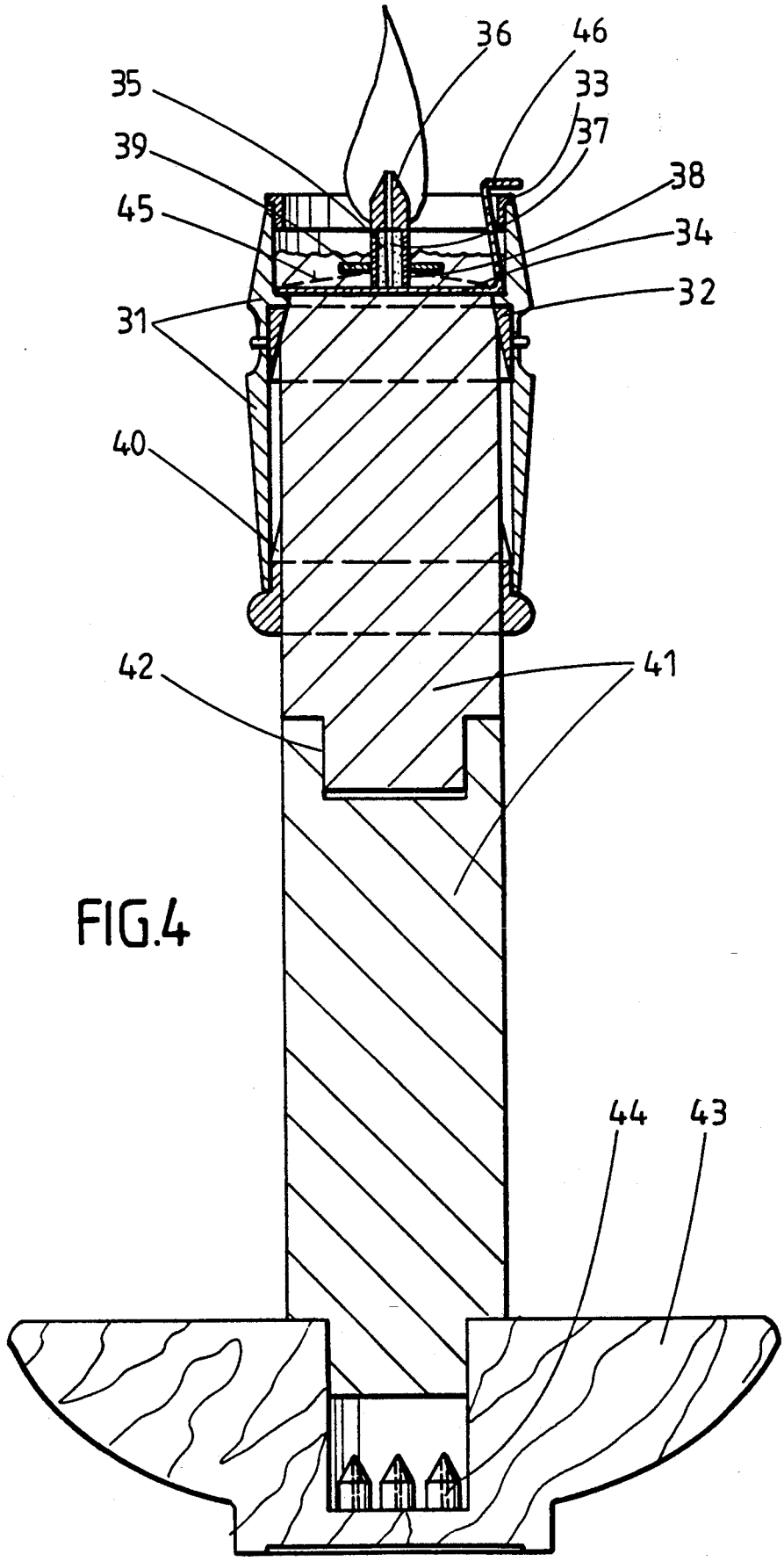
FIG. 4 shows a longitudinal section of a storm lantern without protecting means having an adjustable wick support and cylinder wick.

A storm lantern, which comprises a headpiece 31, wax bodies 41 and a base pedestal 43, is illustrated in FIG. 4. A heat-conducting ring 32 and a vertically adjustable wick support 34 are provided in the headpiece 31. The wick support is supported on inclined faces 45 and can be controlled by an adjusting lever 46. A retention pin 37, on which is mounted a slit sleeve 38 having a glass wool insert 35, is secured in the centre of the wick support 34. A heat-conducting disc 39 is secured to the sleeve 38. A cylinder wick 36, which has a central bore, is mounted on to the top end of the retention pin 37. At the top, the cylinder wick 36 is designed to be conical in order to facilitate lighting-up and it may be composed of gypsum, chalk, glass wool, slag wool or the like. At the bottom, the lower part of the headpiece 31 is adapted in its inside diameter, with a slight clearance, to the diameter of the wax body. The wax bodies 41 are provided with plug-connection means 42 and are placed, at the bottom, in the base pedestal 43. The plug-in opening in the base pedestal 43 is designed to be slightly deeper, such that additional cylinder wicks 44, which serve as stand-by wicks, can be accommodated. At the bottom, the headpiece 31 is provided with a plurality of retaining springs 40 which, when the entity is raised, prevent that the headpiece 31 is detached from the wax body 41.

When the cylinder wick 36 is saturated with wax and is lit, then, as a first step, heat is directed downwards by the wick retention pin 37, and the glass wool insert 35 which is, likewise, saturated with wax is heated up and wax is liquefied, such that there is sufficient wax available for burning for the next few seconds. The sleeve 38, together with the heat-conducting disc 39, is also heated up by the lower peripheral zone of the flame, such that additional wax is melted and can penetrate to the glass wool insert 35 through the slit in the sleeve 38 and is drawn in to the cylinder wick 36. As a result of this arrangement, it is possible that the flame remains burning during the first critical minutes after being lit.

As soon as sufficient heat has been transferred from the liquid wax to the heat-conducting ring 32, the wax within the heat-conducting ring 32 also melts on the contact surface. Since the heat-conducting ring 32 now becomes slightly hotter in the upper region, the wax there has a lower viscosity, whereas it remains pasty in the lower region of the ring, with the result that the melting wax can escape only upwards and cannot run out downwards.

Figure 5:
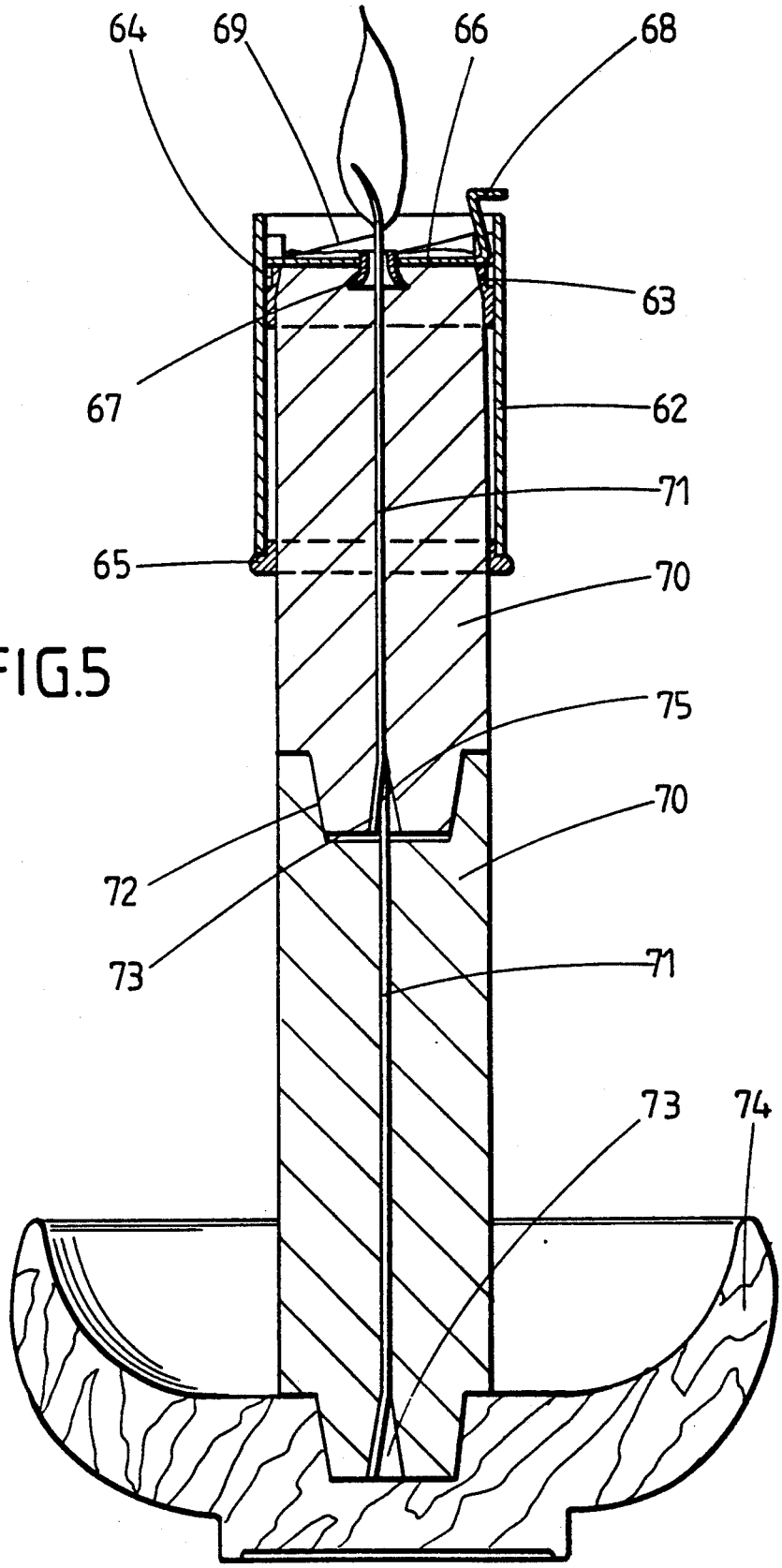
FIG. 5 shows a longitudinal section of a storm lantern having a textile wick retracted into the wax body, a plug connection and a socket support for height adjustment.

A storm lantern is illustrated in FIG. 5 in which a glass cylinder is provided as the headpiece 62 into which is inserted a heat-conducting ring 63 comprising a sealing washer 64 and having inclined faces 69. A rotatable socket support 66 having an adjusting lever 68 and a wick guiding socket 67 is mounted on the inclined faces 69. The wick 71 of the top wax body 70 projects through the socket 67 and is thereby maintained in a vertical position. An end ring 65, which serves as guide, is attached at the bottom end of the headpiece 62. The two wax bodies 70 are interconnected by means of a plug connection 72 of conical design. The bottom plug connection 72 is inserted in a base pedestal 74. At the bottom end of the wax bodies 70, conically designed wick openings 72 are provided, into the wall of which the wicks 71 are, in each case, pressed, such that, when a new wax body 70 is placed underneath, the freely projecting wick end 75 has sufficient space and, thus, lies next to the pressed-in wick end of the superposed wax body. When this connecting point or plug connection ultimately reaches the burning zone, the wick 71 of the top wax body 70, which is burning down, lights the wick 71 of the wax body which is plugged in below it.

The above-described wax body 70 comprising the wick 71 may also be plugged together and burned without a headpiece, but, in such a case, the wax body 70 should be provided on the outside with a layer of hard wax.

The advantages of the storm lantern described are that the wick projects out of the wax only to a predetermined length and a flame that is too large and therefore tends to smoke cannot develop. An overflowing or dripping-down of liquid wax is impossible. A vertical adjustment of the flame is possible. Complete burning of the wax is achieved. There is a limited fire hazard because the ball wick readily falls down, thereby extinguishing the flame. In addition, the manufacture of the wax bodies is considerably simpler and more economical. Moreover, during burning, no wick ash is released into the environment. When, as a result of burning, a wax body becomes smaller and, therefore, optically less attractive, a new wax body can be placed underneath.

Figure 6:
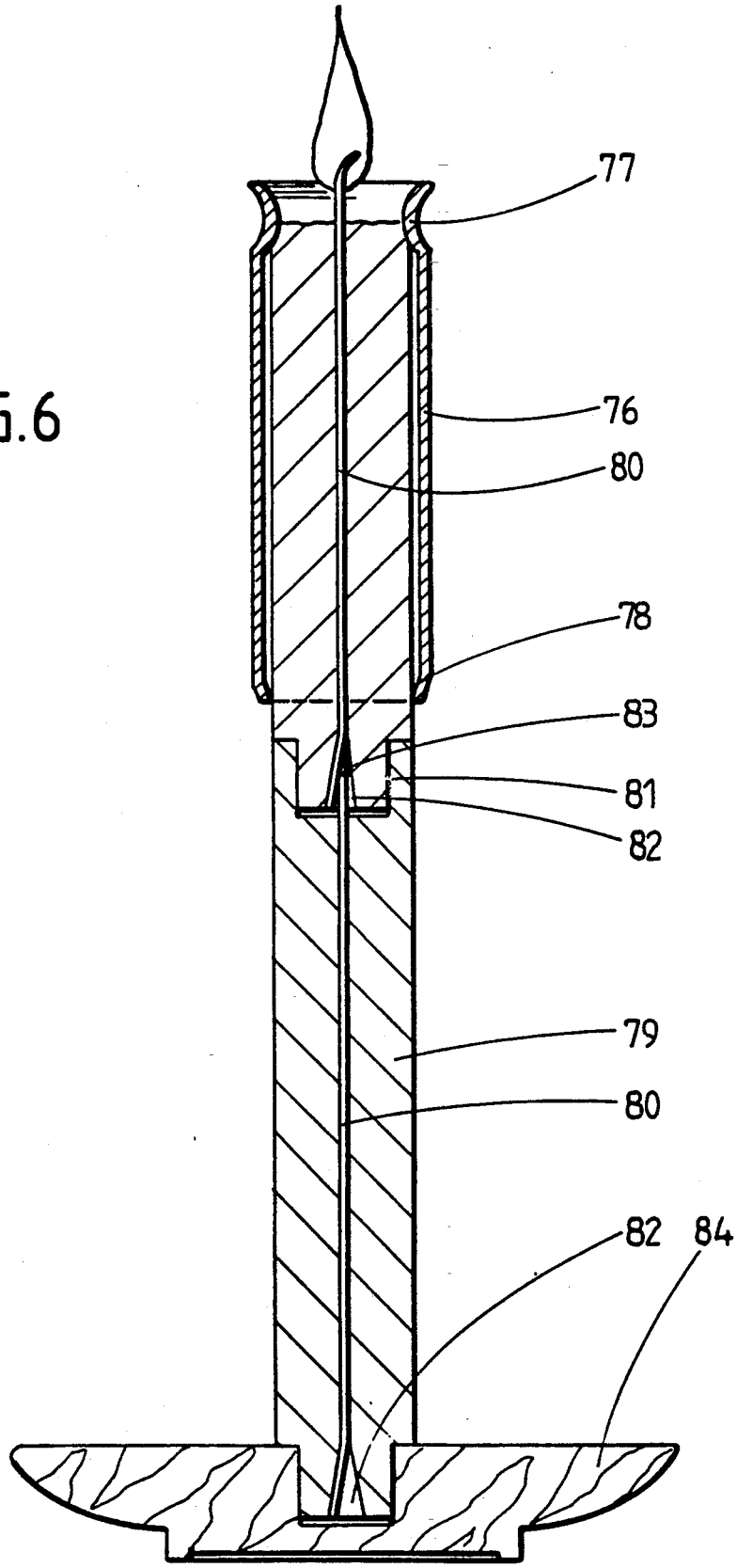
FIG. 6 shows a longitudinal section of a storm lantern having a headpiece, for example of glass, without a heat-conducting ring.

In FIG. 6, a storm lantern is illustrated in the case of which the headpiece 76 is composed of a single part. It may be manufactured of glass, porcelain, melamine or the like, and is provided, at the top, with a constriction which, in its narrowest part, is approximately 1 mm less in diameter than the wax body 79, with the result that a conical supporting surface 77 is formed. At the bottom of the headpiece 76, a narrowing 78 is provided which is slightly greater in diameter than the wax body 79. The wax bodies 79 are provided with a wick 80, a plug connection 81, wick opening 82 and projecting wick end 83, and are placed in position in a base pedestal 84. In this embodiment, the burning zone is disposed lower down, such that the wax body 79 burns hollow at the level of the conical supporting surface 77 and the headpiece 76 moves downwards only when the wax at the bearing face of the conical support 77 has become thin and escapes inwards. The wax thus does not melt down at the conical support 77, but is rather pushed aside inwards. This embodiment is particularly suitable for candles or wax bodies 79 having a small diameter. In the case of this headpiece, too, a commercial candle may be used, but the diameter must be suitable and the base pedestal should comprise a base pedestal cylinder. If the headpiece is manufactured of plastics material, it is advisable to provide an upper end ring 3, 21, 33, 56, which lines the entire interior space of the headpiece 76 at the level of the burning zone, in order to reduce the risk of a fire.

Figure 7:
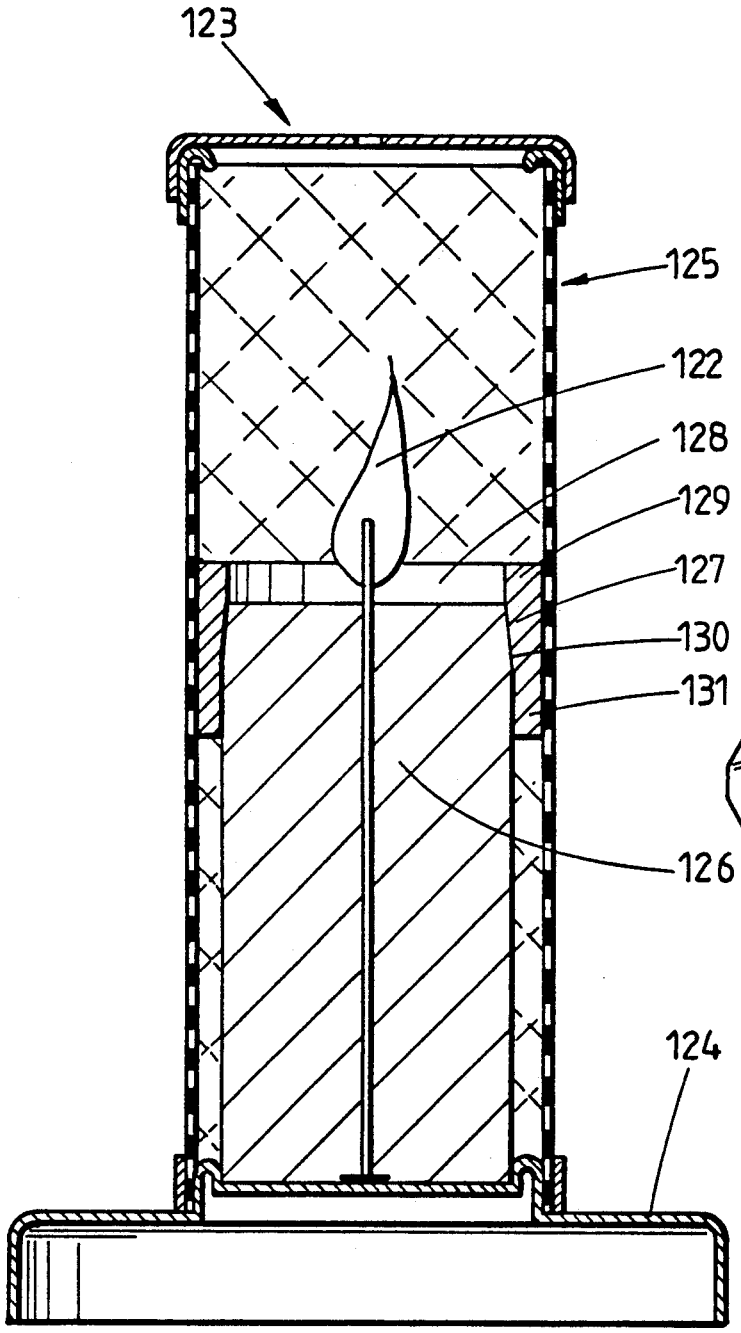
FIG. 7 shows a vertical section of a further embodiment of a storm lantern according to the invention.
Figure 8:
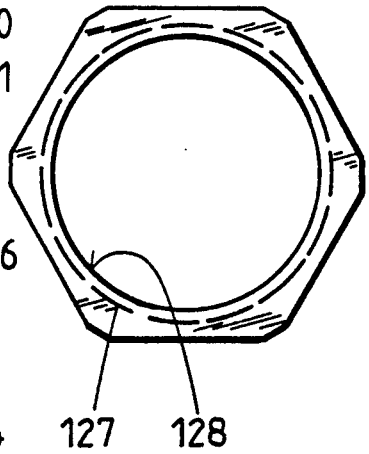
FIG. 8 is a top view of a spacer ring attached between candle and protecting means of the storm lantern of FIG. 7, with the aid of which spacer ring the flame of the candle and the candle itself are held in a central position within the tubular outer covering.

The storm lantern 123 illustrated in FIGS. 7 and 8 has a pedestal 124 designed to be a base, on which is mounted a cylindrical protecting means of incombustible and air-permeable bonded fabrics. A candle 126 is mounted on the pedestal 124 within the protecting means 125, said candle having an outside diameter which is smaller than the inside diameter of the protecting means 125.

A spacer ring 127, the outer contour of which is hexagonal, is mounted on the top end of the candle 126 and ensures that the top end of the candle is disposed so as to be centered relative to the protecting means 125 and that the flame 122 does not come into contact with the wall of the protecting means 125.

Since the outside of the spacer ring 127 is designed to be hexagonal, it is supported on the inside of the cylindrical protecting means 125 only at six points, with the result that air can flow across the outside of the spacer ring 127 within the protecting means.

The inside opening 128 of the spacer ring 127 is shouldered and comprises three sections 129, 130, 131, as can clearly be seen in FIG. 7. Whereas the upper and lower sections 129 and 131 are designed to be cylindrical, the central section 130 forms an approximately conical transition. The upper section 129 has an inside diameter which is smaller than the outside diameter of the candle 126, whereas the lower section 131 has an inside diameter which corresponds to the outside diameter of the candle 126. As a result, it is possible to mount the spacer ring 127 firmly on the top end of the candle 126 such that it projects slightly beyond the top end of the candle 126, where it confines any molten wax produced in order that it cannot run out even if the storm lantern were to be held at a slight inclination when being relocated.

When the candle 126 is burning, the spacer ring 127, which is, for example, of metal or, optionally, also of plastics material, is heated and moves downwards with the flame of the shortening candle. In so doing, it is guided along the candle by its lower section 131, and on the inside of the protecting means 125 by the tips of the outer hexagon, such that it cannot tilt. At its top end, the spacer ring 127 may be extended by a transparent annular projection, which is not shown in this instance, such that a spill-over of liquid wax is rendered even more difficult, without the view of the flame being reduced thereby.

Figure 9:
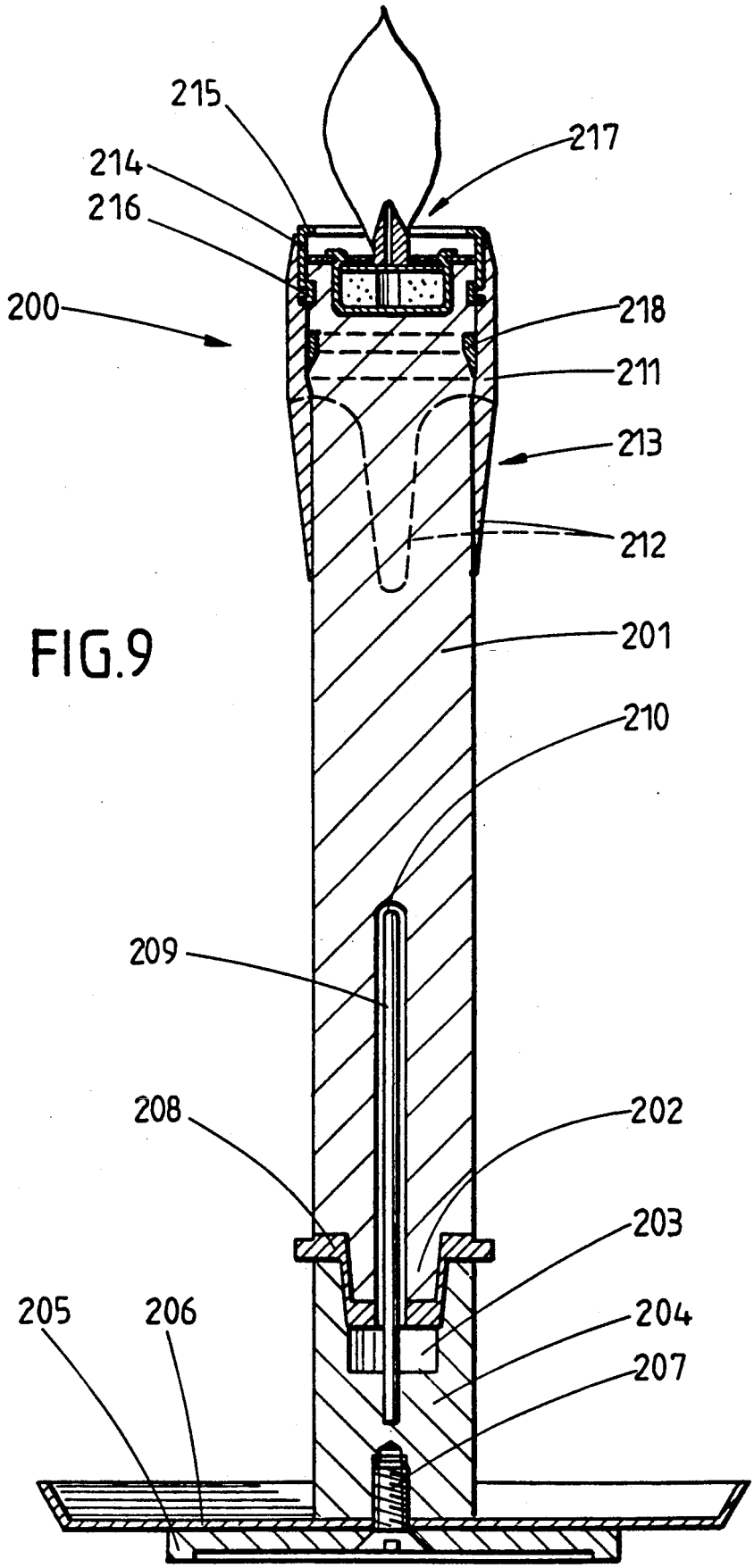
FIG. 9 is a vertical section of a seventh embodiment of a storm-lantern-like candle according to the invention.

The candle 200 shown in FIG. 9 has a cylindrical body 201 composed of wax or paraffin, which, by means of a conical projection 202 provided at the bottom end, is plugged into a corresponding conical opening 203 of a holder 204. Said holder is provided with a base plate 205 and a tray 206 which is arranged thereon and screw-connected to the holder 204 by means of a screw 207.

A conical cap 208 is removably arranged between holder 204 and the body 201 of the candle, which cap may be used to extinguish the flame of the candle 201, such that no annoying dense smoke or soot is released by extinguishing. Said conical cap is stored in the position shown in FIG. 9, in order that it is always available for use.

A pin 209 is secured centrally in the holder 204 and projects into a central bore 210 of the body 201, and serves to hold up the flame and to prevent a continued moving down of the wick support before a further candle body 201 has been plugged in.

At the top end of the body 201 is mounted an annular or collar-like headpiece 211 which comprises downward-pointing finger-like extensions 212 which serve as guide means and which rest, with a close sliding fit, against the peripheral surface of the cylindrical body 201. A sufficiently large clearance 213 is provided, in each case, between the adjacent extensions 212 to enable the candle 200 to be grasped on its body 201 and thereby lifting it, without it being necessary to grasp the headpiece 211. If the headpiece 211 were to be grasped in order to lift the candle 200, it is possible that this would result in the headpiece being pulled away upwards without the candle body 201 and liquid combustible material running out.

Within the annular headpiece 211, at the top end thereof, is provided an insert ring 214 which comprises, both at the top end and at the bottom end, in each case, an inwardly pointing flange 215 and 216, respectively. These two flanges serve as limit stops for the relative vertical movements of a wick support 217 which is designed to be a float and which is described in more detail in connection with FIGS. 11 and 12.

The annular or collar-like headpiece 211 also comprises an inwardly pointing heat-conducting ring 218 which is also intended to prevent a leaking of molten paraffin or wax.

Figure 10:
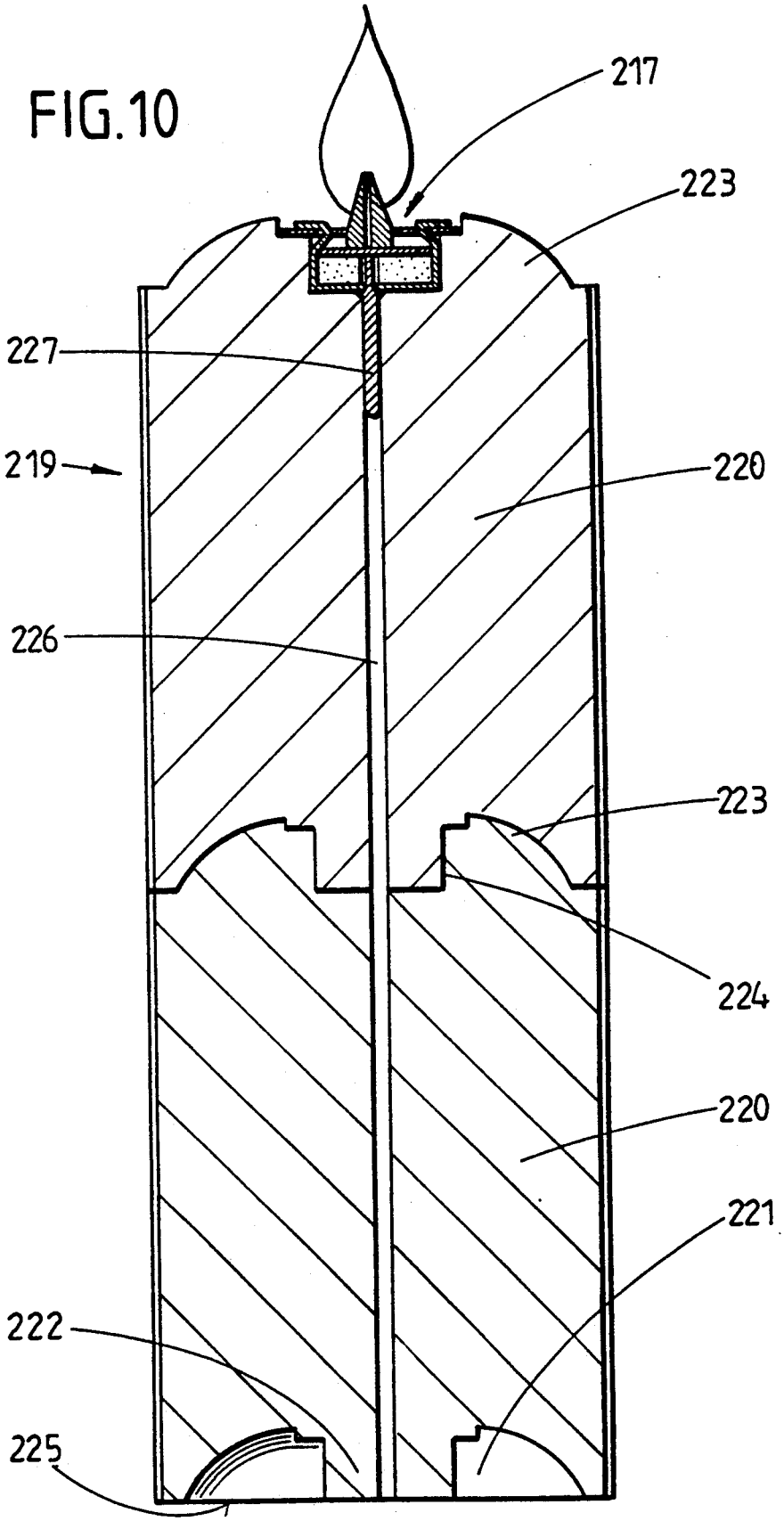
FIG. 10 is a vertical section of an eighth embodiment of a candle according to the invention.

The candle 219 illustrated in FIG. 10 comprises two plug-connected bodies 220 which are composed, in each case, of a combustible material which is solid at normal room temperature, such as wax or paraffin. Each of these bodies 220 has, at the bottom end, an inwardly curved annular recess 221 and a central peg 22, while, at the top end, each body 220 has a corresponding raised annular projection 223 comprising a central recess 224, such that the bodies 220 can be plugged into one another form-lockingly, as shown in FIG. 10. Nevertheless, each body 220 has a bottom level base 225, with the result that no holder or special pedestal is required to set up the candle 219.

The bodies 220, in each case, comprise a continuous central bore 226 into which is inserted a centering pin 227 on which is mounted the wick support 217 which fits into the recess 224 at the top end of each body 220. The centering pin 227 serves not only to maintain the wick support 217 in a central position, but it also prevents that a body 220 burns down too far. This is so, because when the centering pin 227 arrives at the bottom end of a body 220 which is mounted on a support, it ultimately prevents a further downward movement of the wick support which is then raised out of the liquefied combustible material and which, finally, does not receive sufficient combustible material to enable it to continue burning. Indeed, in that case, the flame is extinguished unless, prior thereto, a new body 220 is plugged in.

Figure 11:
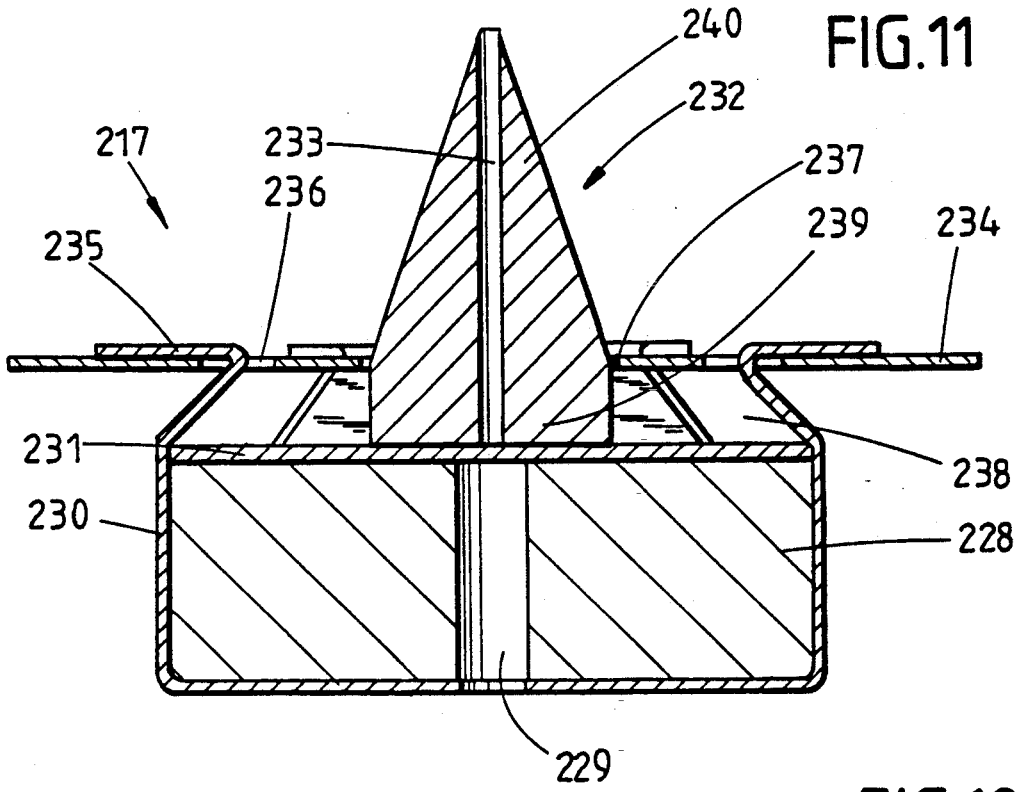
FIG. 11 is a vertical section, enlarged by a factor of approximately five, of a burning element designed as a float for candles according to the invention.
Figure 12:
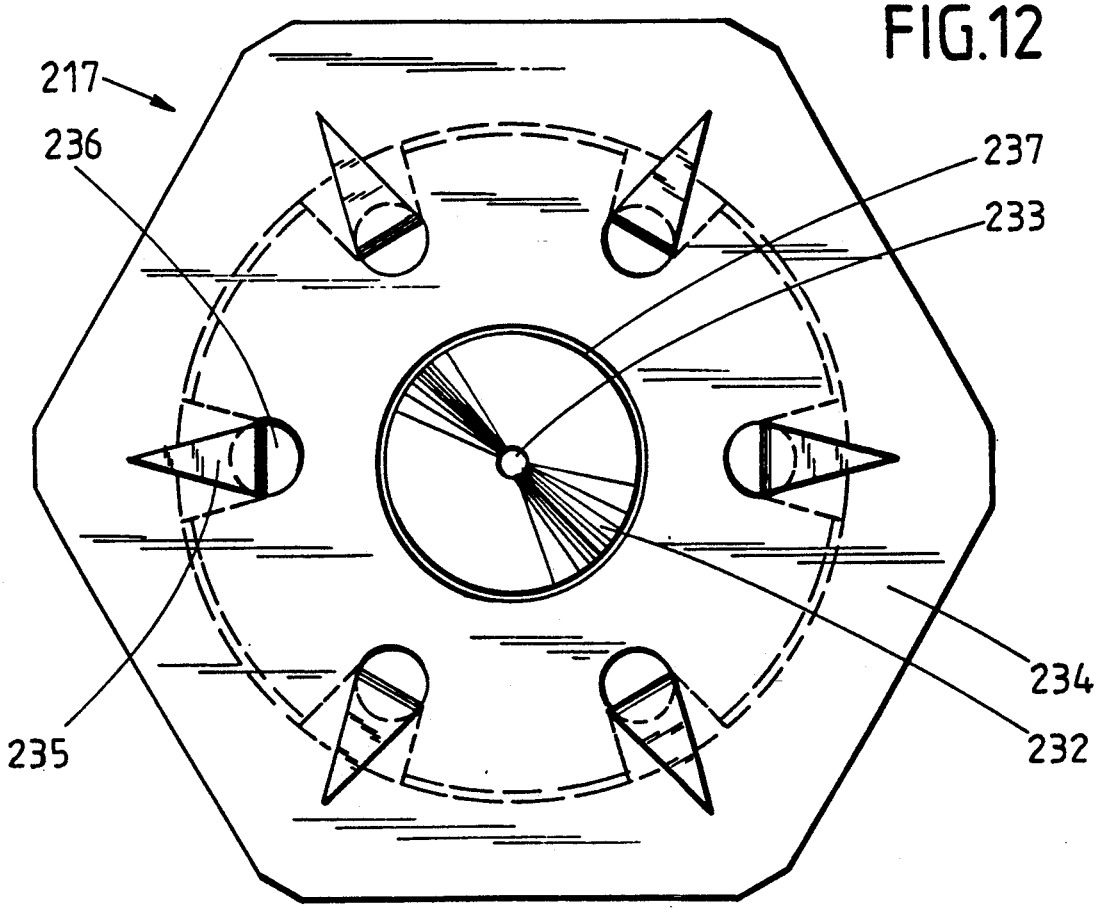
FIG. 12 is a top view of the burning element of FIG. 11.
Figure 13:
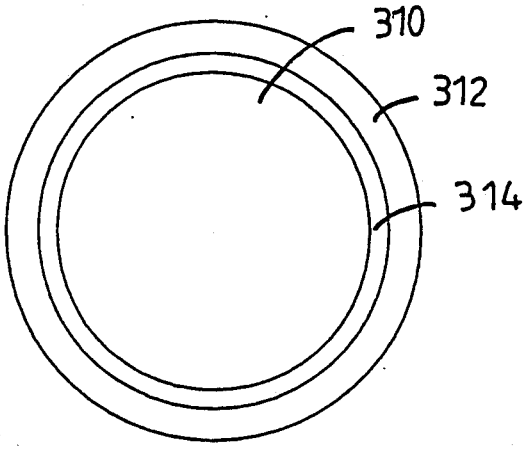
FIG. 13 is a schematic diagram of an axial view of a calibrating mold according to the invention.

The wick support 217 which is shown in detail in FIGS. 11 and 12 comprises a floating body 228 having a central bore 229 which is accommodated in a housing 230 composed of sheet metal.

A disc 231, which is composed of glass fibre matting and on which is mounted a cone wick 232 which is composed of chalk or other porous material, is disposed on the upper side of the floating body 228. The cone wick comprises a central bore 233 to facilitate the upward transportation of liquid burning agent to the top end of the cone wick.

The housing 230 is attached to a thin, foil-like disc 234 of mica and having a substantially hexagonal contour, namely by means of upwardly projecting tongues 235 which are bent outwards and protrude through openings 236 in the disc 234 and which come to lie against the upper side of the disc 234, as can be seen, in particular, in FIG. 11. The disc 234 also comprises a central opening 237 through which the cone wick 232 fits and which also serves to prevent a lateral off-centre displacement of the cone wick 232 which is loosely and replaceably placed on the disc 231 of the floating body 228.

The mica disc 234 is designed such that it extends into close proximity of the insert ring 214 of the headpiece 211 (see FIG. 9) and is supported between the flanges 215 and 216 thereof. Said flanges therefore form limit stops for the wick support 217 which, therefore, cannot move beyond the top edge of the headpiece 211 ar move down too low in the headpiece 211.

As shown in FIG. 11, the wick support 217 comprises an open space 238 between the disc 234, which is composed of non-flammable material such as mica, and the disc 231 of porous glass fibre matting which is supported on the floating body 228, into which open space molten or liquid burning agent such as wax or paraffin can flow for the immediate supply of combustible material or burning agent to the cylindrically designed base 239 of the cone wick 232. In this regard, the burning agent can be melted from the body 201 by the flame of the cone wick 232. It is, however, also possible to pour in molten burning agent prior to lighting. If, when lighting the wick, there is not yet any wax or paraffin in the free space 238, it is possible for the first supply of burning agent to the cone wick, to place wax or paraffin in the form of pieces or rings on the disc 234 around the cone wick 232, which wax or paraffin is then directly melted by the flame and is liquefied.

Since the cone wick 232 is not in contact with good conductors of heat, such as metal, it is also not possible to carry off, rapidly, the heat produced by the flame. Indeed, the heat from the flame remains in the cone wick 232, which is significant in regard to a good burning without non-burned residues.

That end 240 of the cone wick 232 which projects beyond the mica disc 234 is designed to be conical, as shown in FIG. 11, which facilitates lighting and, additionally, promotes a complete burning without non-burned residues.

In order to increase the brightness of the flame, a reflecting metal foil, which is not illustrated, can be placed on the disc 234 of mica, which metal foil covers the disc 234 at the top and serves to reflect, upwardly, the light of the flame radiating downwardly. If soiled, this foil can be replaced and, in a like manner, the cone wick 232 itself is replaceable.

As a result of the combination of the wick support 217, which is illustrated in detail in FIGS. 11 and 12, and the collar-like or annular headpiece 211, a storm-lantern-like candle is obtained, the flame of which burns without flickering, such that a substantially soot-free burning takes place. When the headpiece 211 has moved down into the vicinity of the bottom end of a candle body 201, the wick support 217 comes into contact with the top end of the pin 209, with the result that it cannot continue moving downwards, and the flame is ultimately extinguished due to the absence of further supply of combustible material, unless, prior thereto, a new body of burning agent 201 is placed underneath.

In order to prevent an outflow of molten burning agent or combustible material through the bore 210, when the wick support 217 reaches the top end of the pin 209 an is prevented by said pin 209 from continuing to move downwards, it is possible to arrange below the wick support 217 a small disc or a ball or a cone, not illustrated in the drawing, the outside diameter of which is smaller than the inside diameter of the heat-conducting ring 218. This disc, or ball or cone, can seal off the top end of the bore 210 and keep it closed.

In order to prevent molten burning agent from flowing out of the headpiece 211, when the headpiece is raised or pulled from the body 201, it is possible to arrange, between wick support 217 and heat-conducting ring 218, a solid disc, the outside diameter of which is smaller than the inside diameter of the headpiece but greater than the inside diameter of the heat-conducting ring 218. When the headpiece 211 is raised, said disc can come to lie on the heat-conducting ring 218, thereby closing off the headpiece in a downward direction, such that nothing can flow out. Said disc is preferably composed of incombustible material and, expediently, a material having a poor thermal conductivity.

When a pin 209 which defines the downward movement of the wick support 217 is provided, said pin, in conjunction with the bore 210 which accommodates it, may also serve as centering element, i.e. in that case, a plug connection between a conical projection 201 and a conical opening or recess 203, as shown in FIG. 9, is not required. In this regard, the finger-like extensions 212 of the headpiece 211 not only ensure a guiding, but also a centering of the substantially burned-down body 201 relative to a new body 201 plugged underneath, provided that the length of the pin 209 and the length of the finger-like extensions 212 are appropriately adapted to one another.

In order that the headpiece 211 moves down uniformly with the burning-down candle, or the burning down bodies 201 of combustible material, and in order also to be able to perform a centering function relative to additional subjacently plugged-in bodies 201, it is necessary that the individual bodies 201 composed of combustible material have a uniform outside diameter. This cannot be achieved by the known candle or candle body manufacturing method of dipping, since the tolerances in the outside diameter of dipped candles are too great for this purpose.

According to the invention, it is, therefore, also suggested that cast, extruded or drawn bodies 201 of combustible material or burning agent such as paraffin or wax, centered in a calibrated mould having a larger inside diameter, be coated with a coat of wax or paraffin and, in particular, hard wax, in order to obtain bodies 201 having a uniform outside diameter, i.e. bodies, the outside diameter of which has tolerances which correspond to the inside diameter of the headpiece 211. These tolerances fall within a range of about 0,1 mm.

Figure 3:
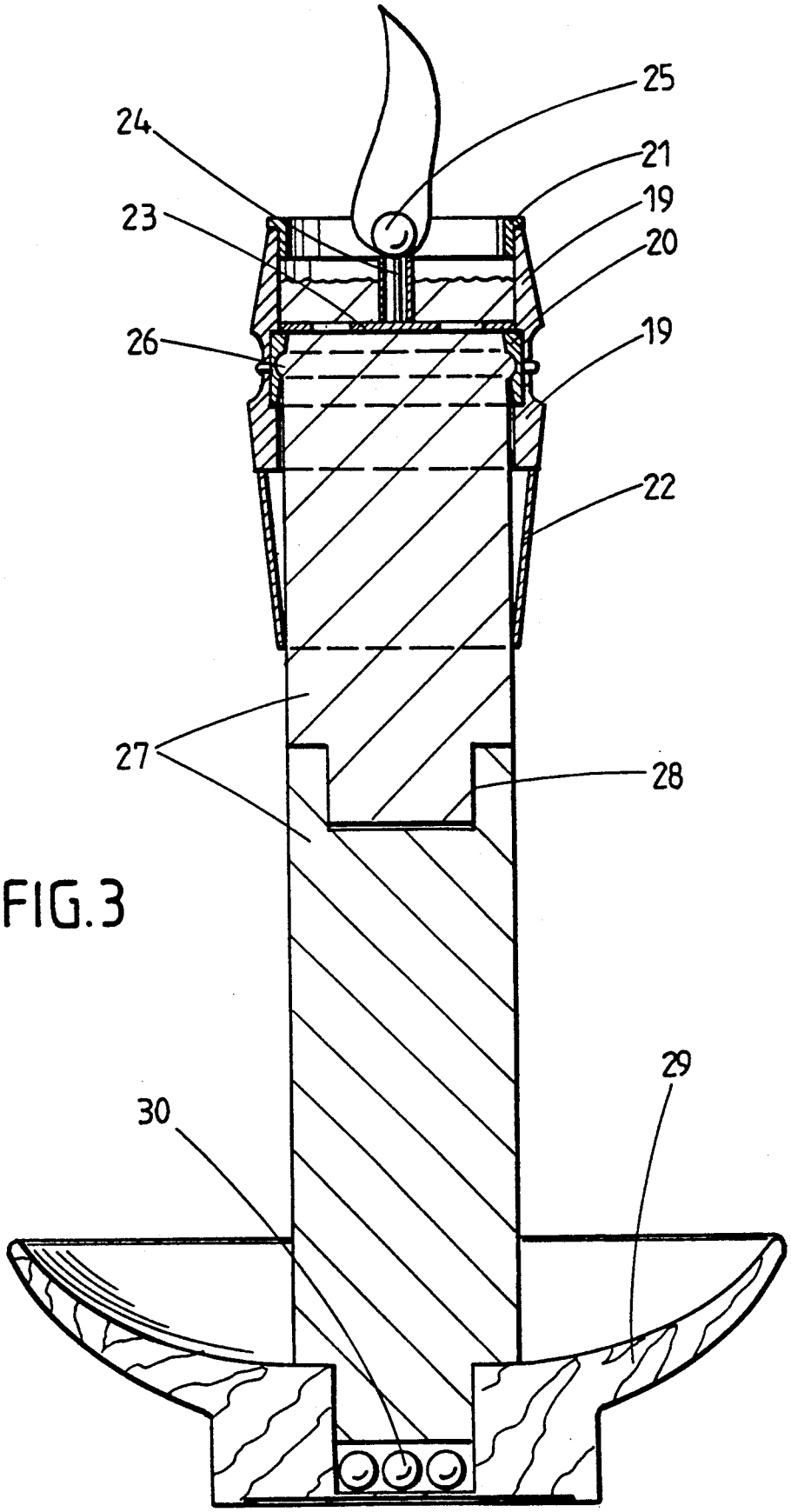
FIG. 3 shows a longitudinal section of a storm lantern without protecting means having a fixed wick support and ball wick.

Referring to FIG. 3, a basic body 310 is manufactured by dipping, drawing, casting, extruding, or pressing. The body 310 is then arranged so as to be centered in a calibrating mold 312 having a slightly larger inside diameter. Hard wax is then introduced into the mold under pressure, forming a sheath-like coating 314 of constant outside diameter on the basic body 310.

Although it is described above that the wick support 217 comprises one cone wick 232, it is also possible to arrange a plurality of wicks such as cone wicks, if this is necessitated by the diameter of the candle.

I claim:

1. A candle comprising:

a body composed of a combustible material which is solid at room temperature and liquid when burned, said body having a top portion and a bottom portion, said bottom portion having means for joining said body to an identical body;

a tubular headpiece surrounding said top portion, said headpiece having a lower portion which guides said headpiece downwardly on said body as said top portion of said body is burned and a heat-conducting ring with sealing means for preventing liquified combustible material from flowing down said body;

a floating wick support, said support located within said tubular headpiece, said support including a housing having a plurality of bendable tongues extending therefrom, a float contained within said housing, an absorbent layer of glass fiber or glass wool matting on said float, and an incombustible centering disk affixed to said support by said bendable tongues and spaced away from said matting, said disk having an opening therein; and a porous cone wick on said matting, said wick extending through said disk opening and having a central longitudinal bore.

2. A candle according to claim 1, wherein said headpiece has inwardly extending upper and lower limit stops and the centering disk extends into close proximity of the inside wall of said tubular headpiece, said stops retaining said centering disk within said headpiece but allowing said disk to move between said upper and lower limit stops.

3. A candle comprising:

a body composed of a combustible material which is solid at room temperature and liquid when burned, said body having a top portion and a bottom portion, said bottom portion having means for joining said body to an identical body;

a tubular headpiece surrounding said top portion, said headpiece having a lower portion which guides said headpiece downwardly on said body as said top portion of said body is burned and a heat-conducting ring with sealing means for preventing liquified combustible material from flowing down said body;

a floating wick support, said support located within said tubular headpiece, said wick support moving downward as said top portion of said body is burned;

a wick supported by said wick support;

means for supporting said body in an upright position;

a vertical pin attached to said supporting means and extending into said body, said pin providing a downward limit to the downward movement of said wick support by the engagement of said pin with said wick support, thereby extinguishing said candle when said downward limit is reached; and means for centering said wick support on said top portion of said body, said floating wick support including an incombustible centering disk affixed to said floating wick support, said centering disk cooperating with said headpiece to keep said floating wick support centered on said top portion of said body.

* * * * *